US005666680A

United States Patent [19]

Hackett, Jr.

[11] Patent Number: 5,666,680

[45] Date of Patent: Sep. 16, 1997

[54] SHEET AND MATTRESS APPARATUS

[76] Inventor: Major Hackett, Jr., 3351 N. Guilford Ave.., Indianapolis, Ind. 46205

[21] Appl. No.: 606,396

[22] Filed: Feb. 23, 1996

[51] Int. Cl.[6] ..... A47G 9/04

[52] U.S. Cl. ..... 5/692; 5/496; 5/499

[58] Field of Search ..... 5/692, 494, 496, 5/497, 498, 499

[56] References Cited

U.S. PATENT DOCUMENTS

| | | | |
|---|---|---|---|
| D. 267,696 | 1/1983 | Adams . | |
| 3,083,378 | 4/1963 | Pursell | 5/498 |
| 3,530,487 | 9/1970 | Beer | 5/494 |
| 3,832,743 | 9/1974 | Smith | 5/496 |
| 3,857,124 | 12/1974 | Hadley | 5/496 |
| 3,965,504 | 6/1976 | Ainsworth . | |
| 4,488,323 | 12/1984 | Colburn | 5/496 X |
| 4,615,061 | 10/1986 | Scott | 5/497 |
| 4,809,375 | 3/1989 | Bull . | |
| 4,858,625 | 8/1989 | Cramer . | |
| 5,070,557 | 12/1991 | Vincent et al. . | |
| 5,208,927 | 5/1993 | Lachmar . | |
| 5,263,212 | 11/1993 | Garcia . | |

*Primary Examiner*—Michael F. Trettel

[57] ABSTRACT

A sheet and mattress apparatus includes a fitted sheet assembly which includes a fitted sheet portion and a first fastener strip attached to and substantially coextensive with an edge of the fitted sheet portion. A mattress assembly includes a mattress portion and a second fastener strip attached to sides of the mattress portion. The second fastener strip is substantially coextensive with the first fastener strip. When the first fastener strip is connected to the second fastener strip, the fitted sheet assembly is connected to the mattress assembly. The first fastener strip can be a first zipper strip. The second fastener strip can be a second zipper strip. A slider assembly is included for zipping and unzipping the first zipper strip with respect to the second zipper strip. In accordance with a second embodiment, the first fastener strip can be a first hook-or-loop material strip, and the second fastener strip can be a complementary second hook-or-loop material strip. In accordance with a third embodiment, a cover sheet assembly includes a cover sheet portion and a third zipper strip attached to an edge of the cover sheet portion. A fourth zipper strip is attached to a side of the fitted sheet portion of the fitted sheet assembly. The fourth zipper strip is substantially coextensive with the third zipper strip. A second slider assembly is provided for zipping and unzipping the third zipper strip with respect to the fourth zipper strip.

3 Claims, 3 Drawing Sheets

SHEET AND MATTRESS APPARATUS

BACKGROUND OF THE INVENTION

1. Field of the Invention

The present invention relates generally to sheets and mattresses and, more particularly, to sheets that are form fitted to mattresses.

2. Description of the Prior Art

Presently, fitted sheets have elastic edges which fit over the sides of mattresses. The tension in the elastic material permits a tight fit of the sheet on the mattress. With time, however, and after undergoing numerous launderings in a clothes washer and numerous dryings in a clothes dryer, the elastic may lose its tension for providing a tight fit for the sheet on the mattress. In this respect, it would be desirable if a fitted sheet fit on a mattress without using elastic materials on the edges of the sheet.

Throughout the years, a number of innovations have been developed relating to mattresses and mattress coverings, and the following U.S. Pat. Nos. are representative of some of those innovations: 3,965,504, 4,809,375, 4,858,625, 5,070,557, 5,208,927, 5,263,212, and Des. 267,696. More specifically, U.S. Pat. No. 3,965,504 discloses a bedding assembly in which certain portions are connected together with zippers. However, there is no disclosure of using a zipper to attach a fitted sheet to a mattress.

U.S. Pat. No. 4,809,375 discloses a mattress that has a removable mattress cover that is attached to the mattress by means of a zipper. The mattress cover is attached to the top of the mattress and does not extend down the sides of the mattress. Therefore, the mattress cover does not serve as a fitted sheet.

Each of U.S. Pat. Nos. 4,858,625 and 5,070,557 discloses a bed covering that is attached to a mattress by means of straps. Such straps do not permit a blanket to be form fitted to the mattress.

U.S. Pat. No. 5,208,927 discloses a bedding apparatus that employs a zipper to connect a blanket to a sheet. However, a form fitted sheet is fitted onto a mattress using well-known elastic bands.

U.S. Pat. No. 5,263,212 discloses a form fitted sheet that is attached to a mattress using a plurality of tensioned straps that pass under the mattress. Lifting a heavy mattress can be a difficult and unwanted chore. In this respect, it would be desirable if a fitted sheet fits on a mattress without using straps that pass under the mattress.

U.S. Pat. No. Des. 267,696 discloses a contoured bed sheet that is not a fitted sheet on a mattress.

Still other features would be desirable in a sheet and mattress apparatus. It would be desirable if a non-elastic-containing fitted sheet snugly fit onto four sides of a mattress. Most times a person uses two sheets on a mattress, a bottom sheet and a top sheet. The person usually lies on top of the bottom sheet and under the top sheet. In this respect, it would be desirable if an upper and lower sheet were provided that are secured together with a zipper.

Thus, while the foregoing body of prior art indicates it to be well known to use sheets associated with mattresses, the prior art described above does not teach or suggest a sheet and mattress apparatus which has the following combination of desirable features: (1) does not use elastic materials on the edges of a sheet; (2) fits on a mattress without using straps that pass under the mattress; (3) provides a non-elastic-containing fitted sheet that fits snugly onto four sides of a mattress; and (4) provides an upper and lower sheet that are secured together with a zipper. The foregoing desired characteristics are provided by the unique sheet and mattress apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a sheet and mattress apparatus which includes a fitted sheet assembly which includes a fitted sheet portion and a first fastener strip attached to and substantially coextensive with an edge of the fitted sheet portion. A mattress assembly includes a mattress portion and a second fastener strip attached to sides of the mattress portion. The second fastener strip is substantially coextensive with the first fastener strip. When the first fastener strip is connected to the second fastener strip, the fitted sheet assembly is connected to the mattress assembly. The first fastener strip can be a first zipper strip. The second fastener strip can be a second zipper strip. A slider assembly, supported by the first zipper strip and the second zipper strip, is included for zipping and unzipping the first zipper strip with respect to the second zipper strip.

In accordance with a second embodiment of the invention, the first fastener strip can be a first hook-or-loop material strip, and the second fastener strip can be a second hook-or-loop material strip which is complementary to the first hook-or-loop material strip.

In accordance with a third embodiment of the invention, a cover sheet assembly includes a cover sheet portion and a third fastener strip attached to an edge of the cover sheet portion. A fourth fastener strip attached to a side of the fitted sheet portion of the fitted sheet assembly. The fourth fastener strip is substantially coextensive with the third fastener strip.

The third fastener strip can be a third zipper strip. The fourth fastener strip can be a fourth zipper strip. A second slider assembly, supported by the third zipper strip and the fourth zipper strip, is provided for zipping and unzipping the third zipper strip with respect to the fourth zipper strip.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sheet and mattress apparatus which has all of the advantages of the prior art and none of the disadvantages.

It is another object of the present invention to provide a new and improved sheet and mattress apparatus which may be easily and efficiently manufactured and marketed.

It is a further object of the present invention to provide a new and improved sheet and mattress apparatus which is of durable and reliable construction.

An even further object of the present invention is to provide a new and improved sheet and mattress apparatus which is susceptible of a low cost of manufacture with regard to both materials and labor, and which accordingly is then susceptible of low prices of sale to the consuming public, thereby making such sheet and mattress apparatus available to the buying public.

Still yet a further object of the present invention is to provide a new and improved sheet and mattress apparatus which does not use elastic materials on the edges of a sheet.

Still another object of the present invention is to provide a new and improved sheet and mattress apparatus that fits on a mattress without using straps that pass under the mattress.

Yet another object of the present invention is to provide a new and improved sheet and mattress apparatus which provides a non-elastic-containing fitted sheet that fits snugly onto four sides of a mattress.

Even another object of the present invention is to provide a new and improved sheet and mattress apparatus that provides an upper and lower sheet that are secured together with a zipper.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
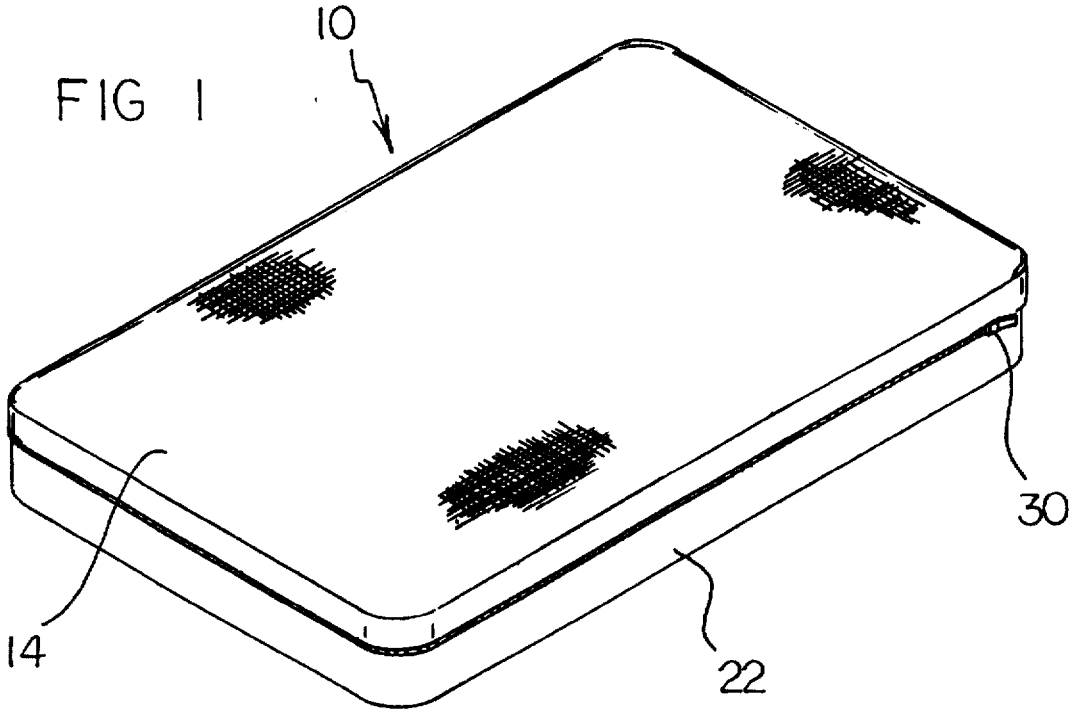
FIG. 1 is a perspective view showing a first embodiment of the sheet and mattress apparatus of the invention wherein the sheet assembly is fully fitted onto the mattress assembly.
Figure 2:
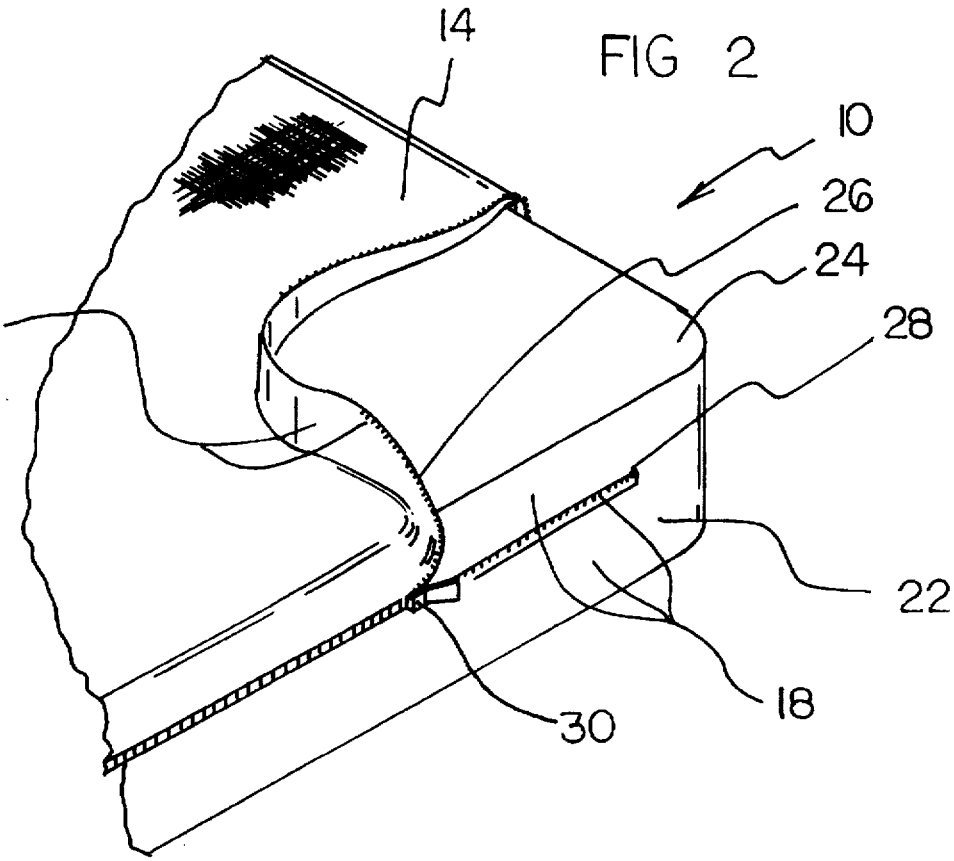
FIG. 2 is a partially enlarged perspective of a corner of the embodiment of the invention shown in FIG. 1 wherein a corner of the sheet assembly is unzipped from the mattress assembly.
Figure 3:
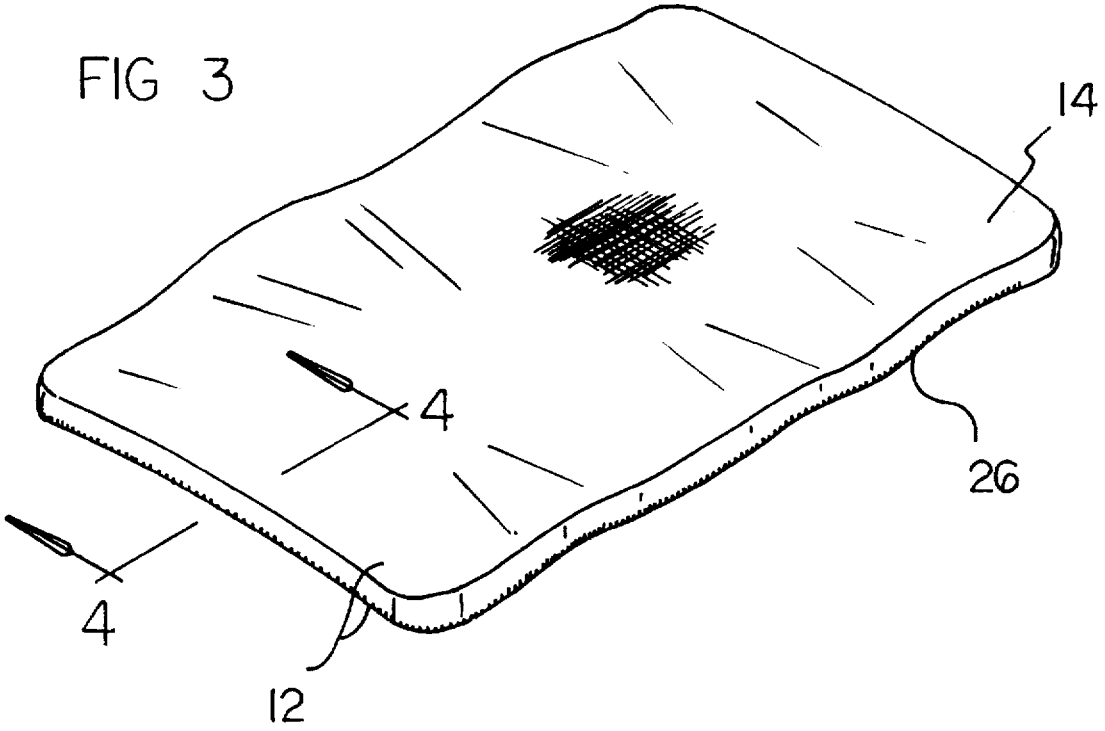
FIG. 3 is a perspective view of the sheet assembly of the embodiment of the invention shown in FIGS. 1 and 2 completely removed from the mattress assembly.
Figure 4:
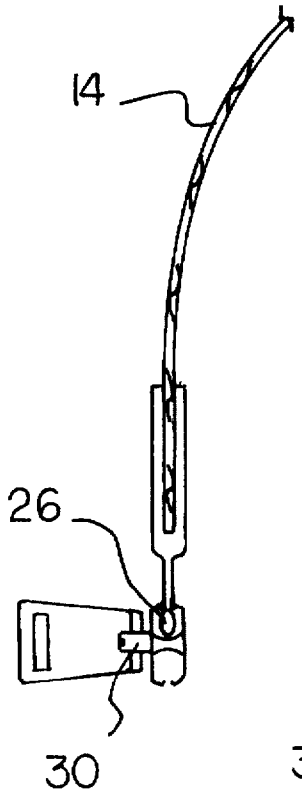
FIG. 4 is an enlarged cross-sectional view of the portion of the embodiment of the invention shown in FIG. 3 taken along line 4—4 of FIG. 3.

With reference to the drawings, a new and improved sheet and mattress apparatus embodying the principles and concepts of the present invention will be described.

Turning to FIGS. 1–4, there is shown a first embodiment of the sheet and mattress apparatus of the invention generally designated by reference numeral 10. In the first embodiment, the mattress apparatus 10 includes a fitted sheet assembly 12 which includes a fitted sheet portion 14 and a first fastener strip attached to and substantially coextensive with an edge of the fitted sheet portion 14. A mattress assembly 18 includes a mattress portion 24 and a second fastener strip attached to sides 22 of the mattress portion 24. The second fastener strip is substantially coextensive with the first fastener strip. When the first fastener strip is connected to the second fastener strip, the fitted sheet assembly 12 is connected to the mattress assembly 18. The first fastener strip can be a first zipper strip 26. The second fastener strip can be a second zipper strip 28. A slider assembly 30, supported by the first zipper strip 26 and the second zipper strip 28, is included for zipping and unzipping the first zipper strip 26 with respect to the second zipper strip 28.

In using the first embodiment of the sheet and mattress apparatus 10 of the invention, the fitted sheet assembly 12 has a first zipper strip 26 extending substantially along the entire edge of the fitted sheet assembly 12 adjacent to the fitted sheet portion 14. In addition, the mattress assembly 18 has a second zipper strip 28 extending substantially around four sides 22 of the mattress assembly 18. The slider assembly 30 is moved to the beginning of the second zipper strip 28. The beginning of the first zipper strip 26 is inserted into the slider assembly 30. The slider assembly 30 is pulled around the entire edge to the ends of the first zipper strip 26 and the second zipper strip 28. In this way, the fitted sheet assembly 12 is connected to the mattress assembly 18. To remove the fitted sheet assembly 12 from the mattress assembly 18, the slider assembly 30 is moved in the opposite direction to unzip the first zipper strip 26 from the second zipper strip 28.

Figure 5:
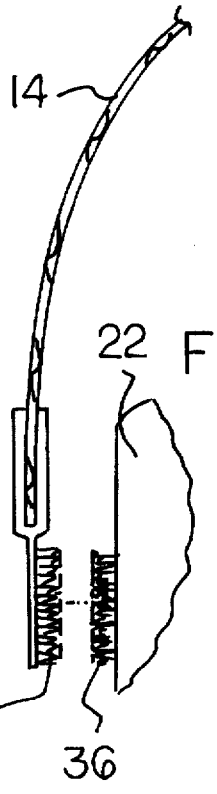
FIG. 5 is a cross-sectional view of a portion of a second embodiment of the invention shown in FIG. 3 wherein a hook and loop connector material is used instead of a zipper for connecting the sheet assembly to the mattress assembly.

Turning to FIG. 5, a second embodiment of the invention is shown. Reference numerals are shown that correspond to like reference numerals that designate like elements shown in the other figures. In this embodiment, the first fastener strip is a first hook-or-loop material strip 34, and the second fastener strip is a second hook-or-loop material strip 36 which is complementary to the first hook-or-loop material strip 34.

In using the second embodiment of the invention, the first hook-or-loop material strip 34 on the fitted sheet assembly 12 is attached by finger pressure onto the second hook-or-loop material strip 36 of the mattress assembly 18. In this way, the fitted sheet assembly 12 is attached to the mattress assembly 18. To remove the fitted sheet assembly 12 from the mattress assembly 18, the first hook-or-loop material strip 34 is pulled away from the second hook-or-loop material strip 36.

Figure 6:
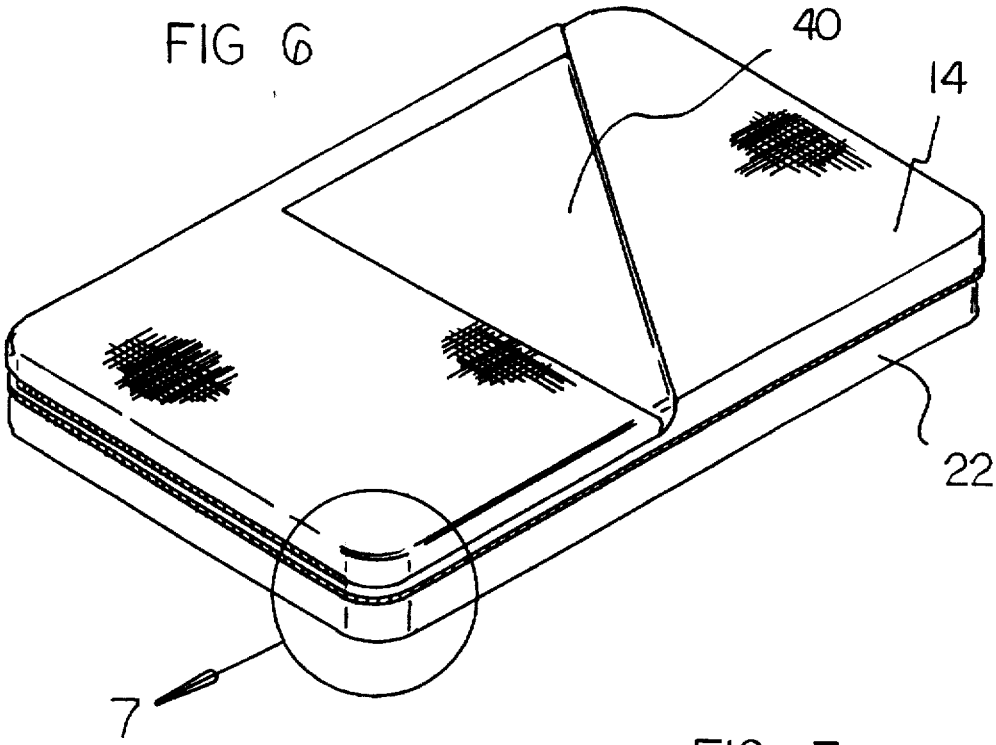
FIG. 6 is a perspective view of a third embodiment of the invention which includes a top sheet attached to a bottom sheet using a zipper.
Figure 7:
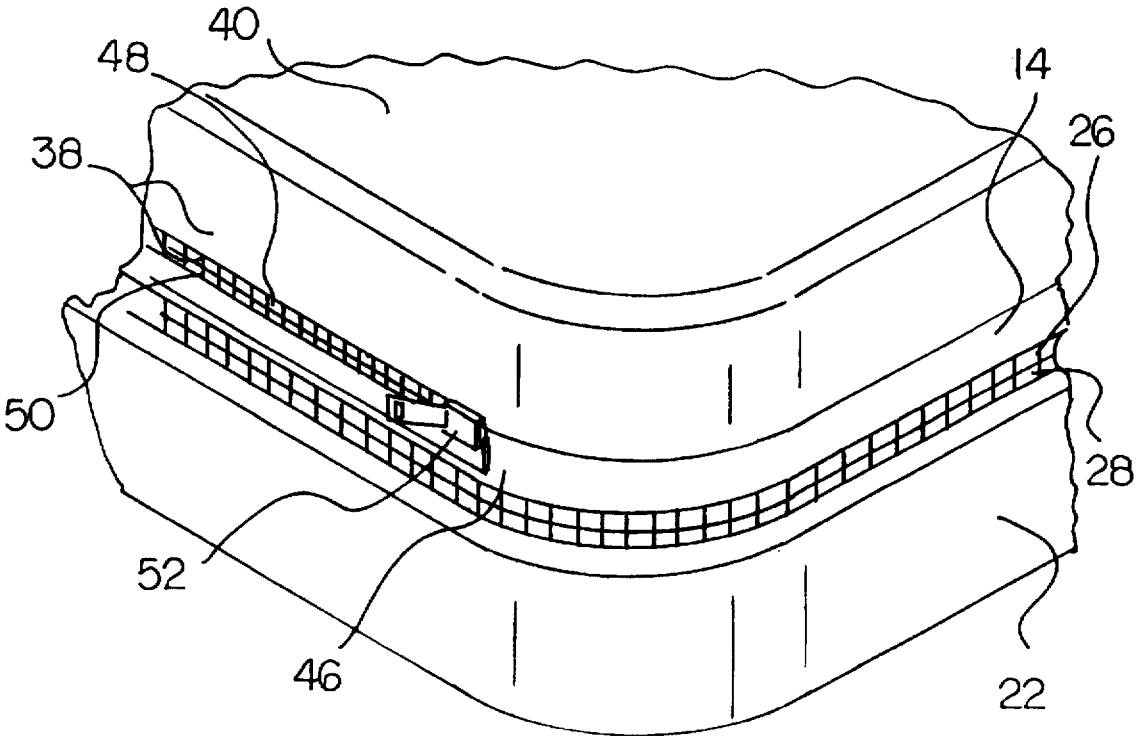
FIG. 7 is an enlarged perspective view of the portion of the embodiment of the invention shown in circled region 7 of FIG. 6.

Turning to FIGS. 6–7, a third embodiment of the invention is shown. Reference numerals are shown that correspond to like reference numerals that designate like elements shown in the other figures. In addition, a cover sheet assembly 38 includes a cover sheet portion 40 and a third fastener strip attached to an edge of the cover sheet portion 40. A fourth fastener strip attached to a side 46 of the fitted sheet portion 14 of the fitted sheet assembly 12. The fourth fastener strip is substantially coextensive with the third fastener strip.

The third fastener strip can be a third zipper strip 48. The fourth fastener strip can be a fourth zipper strip 50. A second slider assembly 52, supported by the third zipper strip 48 and the fourth zipper strip 50, is provided for zipping and unzipping the third zipper strip 48 with respect to the fourth zipper strip 50.

In using the third embodiment of the invention, the fitted sheet assembly 12 is first attached to the mattress assembly 18 using the first zipper strip 26, the second zipper strip 28, and the slider assembly 30. Then, the cover sheet assembly 38 is attached to the fitted sheet assembly 12. This is done by moving the second slider assembly 52 to the beginning of the fourth zipper strip 50. The beginning of the third zipper strip 48 is moved into the second slider assembly 52, and the second slider assembly 52 is pulled towards the end of both the third zipper strip 48 and the fourth zipper strip 50. In this way, the cover sheet assembly 38 is zipped onto the fitted sheet assembly 12. To remove the cover sheet assembly 38 from the fitted sheet assembly 12, the second slider assembly 52 is pulled in the opposite direction to unzip the third zipper strip 48 from the fourth zipper strip 50. Then, the cover sheet assembly 38 is separated from the fitted sheet assembly 12. When person uses the third embodiment of the invention, the person lies on top of the fitted sheet portion 14 of the fitted sheet assembly 12 and under the cover sheet portion 40 of the cover sheet assembly 38. As best shown in FIG. 7, the cover sheet portion 40 has an end side and a lower edge (not labeled). The end side of the cover sheet portion 40 extends directly upward from the lower edge of the cover sheet portion 40 towards the top of the fitted sheet portion 14 such that the end side of the cover sheet portion is positioned flatly against the end side of the fitted sheet portion. Preferably and as shown in FIG. 7, the third fastener strip 48 is coupled to the fourth fastener strip 50 in such a manner that a pulling of the cover sheet relative to the fitted sheet will create a tension force between the third and fourth fastener strips, but will not rotate the third fastener strip relative to the fourth fastener strip.

In a fourth embodiment of the invention, not illustrated in the drawings, the third fastener strip can be in the form of a third hook-or-loop material strip, and the fourth fastener strip can be in the form of a complementary fourth hook-or-loop material strip.

The components of the sheet and mattress apparatus of the invention can be made from inexpensive and durable cloth, metal, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sheet and mattress apparatus that is low in cost, relatively simple in design and operation, and which may advantageously be used without employing elastic materials on the edges of a sheet. With the invention, a sheet and mattress apparatus is provided which fits on a mattress without using straps that pass under the mattress. With the invention, a sheet and mattress apparatus provides a non-elastic-containing fitted sheet that fits snugly onto four sides of a mattress. With the invention, a sheet and mattress apparatus provides an upper and lower sheet that are secured together with a zipper.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A sheet and mattress apparatus comprising:

a fitted sheet portion having a top, said fitted sheet portion further having an end side and an edge;

a first fastener strip attached to and substantially coextensive with said edge of said fitted sheet portion;

a mattress portion having sides;

a second fastener strip attached to said sides of said mattress portion, said second fastener strip being secured to said first fastener strip, said second fastener strip being substantially coextensive with said first fastener strip;

a cover sheet portion having an end side and a lower edge, said end side of said cover sheet portion extending directly upward from said lower edge of said cover sheet portion towards said top of said fitted sheet portion such that said end side of said cover sheet portion is positioned flatly against said end side of said fitted sheet portion;

a third fastener strip attached to said lower edge of said cover sheet portion, said third fastener strip comprising a zipper strip;

a fourth fastener strip attached to said end side of said fitted sheet portion of said fitted sheet assembly, said third fastener strip being secured to said fourth fastener strip, said fourth fastener strip being substantially coextensive with said third fastener strip, said fourth fastener strip comprising a zipper strip;

wherein said third fastener strip is coupled to said fourth fastener strip in such a manner that a pulling of said cover sheet relative to said fitted sheet will create a tension force between said third and fourth fastener strips and will not rotate said third fastener strip relative to said fourth fastener strip.

2. The apparatus of claim 1 wherein said first and second fastener strips comprise zipper strips.

3. The apparatus of claim 1 wherein said first and second fastener strips comprise complementary hook-or-loop material strips.

* * * * *